US009949030B2

(12) United States Patent
Sun et al.

(10) Patent No.: US 9,949,030 B2
(45) Date of Patent: Apr. 17, 2018

(54) ACOUSTIC DEVICE

(71) Applicant: Bose Corporation, Framingham, MA (US)

(72) Inventors: Zhen Sun, Westborough, MA (US); Carl Jensen, Waltham, MA (US); Ray Scott Wakeland, Marlborough, MA (US); Paul T. Bender, Framingham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 15/174,248

(22) Filed: Jun. 6, 2016

(65) Prior Publication Data

US 2017/0353793 A1 Dec. 7, 2017

(51) Int. Cl.

| | |
|---|---|
| ***H04R 25/00*** | (2006.01) |
| ***H04R 3/04*** | (2006.01) |
| ***H04R 1/10*** | (2006.01) |
| ***H04R 1/32*** | (2006.01) |
| ***H04R 3/12*** | (2006.01) |
| ***H04R 5/02*** | (2006.01) |
| *H04R 5/04* | (2006.01) |

(52) U.S. Cl.

CPC ..... *H04R 3/04* (2013.01); *H04R 1/1083* (2013.01); *H04R 1/323* (2013.01); *H04R 3/12* (2013.01); *H04R 5/02* (2013.01); *H04R 1/1008* (2013.01); *H04R 5/04* (2013.01)

(58) Field of Classification Search

CPC H04R 5/033; H04R 1/1008; H04R 2205/022; H04R 1/1016; H04R 1/1075; H04R 1/1083; H04R 2420/07; H04R 3/005; H04R 3/12

USPC ..... 381/300, 307, 309, 310

See application file for complete search history.

(56) References Cited

U.S. PATENT DOCUMENTS

| | | | | |
|---|---|---|---|---|
| 4,005,278 A * | 1/1977 | Gorike | H04R 5/033 | 181/137 |
| 4,644,581 A * | 2/1987 | Sapiejewski | H04R 1/1083 | 381/372 |
| 5,134,659 A * | 7/1992 | Moseley | G10K 11/1788 | 381/163 |
| 5,953,434 A * | 9/1999 | Boyden | H04R 3/12 | 381/301 |

(Continued)

FOREIGN PATENT DOCUMENTS

| | | |
|---|---|---|
| WO | 95/34184 A1 | 12/1995 |
| WO | 96/28000 A1 | 9/1996 |

OTHER PUBLICATIONS

Pierce, Allan D., Acoustics: An Introduction to Its Physical Principles and Applications, Equation (4-4.12), p. 170, Reprint, Acoustical Society of America, 1989.

(Continued)

*Primary Examiner* — Matthew Eason
*Assistant Examiner* — Julie X Dang
(74) *Attorney, Agent, or Firm* — Brian M. Dingman; Dingman IP Law, PC

(57) ABSTRACT

An acoustic device that is adapted to be worn on the body of a user. The acoustic device has an array of acoustic transducers comprising at least three acoustic radiating surfaces, and a controller that is adapted to provide array control signals that independently control the relative phases and amplitudes of each of the transducers.

25 Claims, 15 Drawing Sheets

(56) References Cited

U.S. PATENT DOCUMENTS 6,356,644 B1 * 3/2002 Pollak ..... H04R 1/1008 181/129
7,155,025 B1 * 12/2006 Weffer ..... H04R 5/033 381/370
8,750,541 B1 * 6/2014 Dong ..... H04R 3/12 381/182
9,100,732 B1 8/2015 Dong et al.
2003/0103637 A1 * 6/2003 Huang ..... H04R 1/1075 381/309
2005/0221867 A1 10/2005 Zurek et al.
2005/0276430 A1 * 12/2005 He ..... H04S 3/004 381/309
2006/0045294 A1 * 3/2006 Smyth ..... H04S 7/304 381/309
2006/0198527 A1 * 9/2006 Chun ..... H04S 3/00 381/17
2008/0080733 A1 * 4/2008 Mei ..... H04R 1/1066 381/379
2008/0199023 A1 * 8/2008 Kantola ..... H04R 3/005 381/92
2010/0080400 A1 * 4/2010 Sibbald ..... H04R 3/002 381/71.6
2012/0146752 A1 * 6/2012 Fullerton ..... H05K 9/00 335/306
2013/0051585 A1 2/2013 Karkkainen et al.
2014/0169579 A1 * 6/2014 Azmi ..... G10K 11/16 381/71.6
2016/0021449 A1 1/2016 Litovsky et al.

OTHER PUBLICATIONS

The International Search Report and The Written Opinion of The International Searching Authority dated Sep. 1, 2017 for PCT Application No. PCT/US2017/035913.

* cited by examiner

ACOUSTIC DEVICE

BACKGROUND

This disclosure relates to an acoustic device.

Headphones are typically located in, on or over the ears. One result is that outside sound is occluded. This has an effect on the wearer's ability to participate in conversations. This also has an effect on the wearer's environmental/situational awareness. It is thus desirable at least in some situations to allow outside sounds to reach the ears of a person using headphones.

Headphones can be designed to sit off the ears so as to allow outside sounds to reach the wearer's ears, and for increased comfort. However, in such cases sounds produced by the headphones can become audible to others. When headphones are not located on or in the ears, it is preferable to inhibit sounds produced by the headphones from being audible to others.

SUMMARY

The acoustic device disclosed herein has an array of acoustic transducers that together have at least three radiating surfaces per ear. The radiating surfaces are typically close to (e.g., within 100-200 mm of) the ears, but off the ears, for increased comfort and so that the wearer can hear conversations and other environmental sounds. A controller provides control signals to the transducers. The control signals independently control the relative phases and the amplitudes of each of the transducers. This allows the output of the acoustic device to be tailored to meet requirements of the user with respect to the desired sound pressure level (SPL) at the ears, the acoustic environment, and the need to inhibit radiated acoustic power.

All examples and features mentioned below can be combined in any technically possible way.

In one aspect, an acoustic device that is adapted to be worn on the body of a user includes an array of acoustic transducers comprising at least three acoustic radiating surfaces. There is a controller that is adapted to provide array control signals that independently control the relative phases and amplitudes of each of the transducers. The transducers can include one or more of "monopole", "dipole", or "quadrupole" transducers, where the adjective refers to the dominant term of a multipole expansion of the radiation at low frequencies. Mathematically, an acoustic radiation pattern can be decomposed into a multipole expansion, which is well known in the art.

See, e.g., Pierce, Allan D., "Acoustics: An introduction to its Physical Principles and Applications," Acoustical Society of America, 1989, equation (4-4.12), p. 170. A "monopole transducer" is then one that radiates primarily due to net volume displacement (such as when the back of an oscillatable structure is in a sealed enclosure), a "dipole transducer" is one that has substantially zero net volume displacement, so that its radiation is dominated by the second term of the multipole expansion, and a "quadrupole transducer" is one where a yet higher term dominates the radiation in the low frequency limit, that is when the wavelength is much longer than dimensions characteristic of the transducer (such as the diameter of a round transducer).

Embodiments may include one of the following features, or any combination thereof. The array of acoustic transducers may comprise first and second dipole transducers, each such dipole transducer comprising an oscillatable structure with opposed front and back sides. The first dipole transducer may be closer to an expected location of a first ear of the user than is the second dipole transducer. The control signals may be frequency dependent. The control signals may change (e.g., reduce) the amplitude of the second dipole transducer relative to that of the first dipole transducer over at least a first frequency range of the acoustic device. The second dipole transducer may be different in size (smaller or larger) than the first dipole transducer. The control signals may vary the phases of the first and second dipole transducers relative to each other. The array of acoustic transducers may further comprise a third dipole transducer that comprises an oscillatable structure with opposed front and back sides. The acoustic device may further comprise a tube acoustically coupled to a radiating surface of at least one dipole transducer, to carry sound closer to the expected location of an ear of the user.

Embodiments may include one of the following features, or any combination thereof. The array of acoustic transducers may comprise at least three monopole transducers each comprising a single acoustic radiating surface. The array of acoustic transducers may comprise four monopole transducers that are generally arranged along an axis, wherein a first monopole transducer is closest to an expected location of a first ear of the user, a second monopole transducer is proximate the first monopole transducer, a third monopole transducer is proximate the second monopole transducer, and a fourth monopole transducer is proximate the third monopole transducer. Over at least most of an operating frequency range of the acoustic device, the control signals may cause the phase of the first and third monopole transducers to be opposite the phase of the second and fourth monopole transducers. Over at least most of an operating frequency range of the acoustic device, the control signals may cause the second and third monopole transducers to each have an amplitude that is greater than that of the first and fourth monopole transducers. Over at least most of the operating frequency range of the acoustic device, the control signals may cause the second monopole transducer to have the highest amplitude, the third monopole transducer to have the next highest amplitude, the first monopole transducer to have the next highest amplitude and the fourth monopole transducer to have the lowest amplitude. In one specific, non-limiting example, at a frequency of about 50 Hz the control signals cause the first, second, and third monopole transducers to have the same phase, and the fourth monopole transducer to have the opposite phase, at a frequency of about 120 Hz the control signals may cause the first and second monopole transducers to have the same phase, and the third and fourth monopole transducers to have the opposite phase, at a frequency of about 300 Hz the control signals may cause the first and fourth monopole transducers to have the same phase, and the second and third monopole transducers to have the opposite phase, and at a frequency of about 1 kHz the control signals may cause the first and third monopole transducers to have the same phase, and the second and fourth monopole transducer to have the opposite phase.

Embodiments may include one of the following features, or any combination thereof. A first radiating surface may be closer to an expected location of an ear of the user than is a second radiating surface. The array may comprise at least one dipole transducer that comprises an oscillatable structure with opposed front and back sides, and at least one monopole transducer that comprises a single acoustic radiating surface. The array may comprise at least one dipole transducer and at least two monopole transducers that each comprise a single acoustic radiating surface and a back cavity. The back cavities may be acoustically coupled together. The acoustic device may further include a tube acoustically coupled to the radiating surface of at least one monopole transducer, to carry the radiated sound to another location.

Embodiments may include one of the following features, or any combination thereof. The control signals may reduce or eliminate the contribution of one or more transducers of a transducer array in a frequency range. For example, smaller transducers may be used to reduce spillage, but only at higher frequencies. The control signals may control at least one of the amplitudes and phases of the transducers; this control may be but need not be in response to ambient noise levels. The array may comprise transducers of different sizes. The array may comprise at least two acoustic transducers, wherein a first acoustic transducer is smaller in size than a second acoustic transducer. The first acoustic transducer may be located farther from the expected location of an ear of the user than is the second acoustic transducer, or the first acoustic transducer may be located closer to the expected location of an ear of the user than is the second acoustic transducer. There may be a tube acoustically coupled to a radiating surface of a transducer so as to carry sound radiated by the radiating surface. The tube may have an opening located closer to the expected location of an ear of the user than the location of the radiating surface itself.

Embodiments may include one of the following features, or any combination thereof. At a first frequency range the control signals may cause the array of acoustic transducers to act approximately like a monopole, at a second frequency range, higher than the first frequency range, the control signals may cause the array of acoustic transducers to act approximately like a dipole, and at a third frequency range, higher than the first and second frequency ranges, the control signals may cause the array of acoustic transducers to act approximately like a quadrupole. At a fourth frequency range, higher than the first, second and third frequency ranges, the control signals may cause the array of acoustic transducers to act approximately like a multipole of a higher order than a quadrupole.

In another aspect, an acoustic device that is adapted to be worn on the body of a user includes an array of acoustic transducers comprising at least three acoustic radiating surfaces, the array comprising transducers of different sizes, and a controller that is adapted to provide array control signals that independently control the relative phases and amplitudes of each of the transducers, wherein the control signals may control at least one of the amplitudes and phases of the transducers in response to ambient noise levels.

In another aspect, an acoustic device that is adapted to be worn on the body of a user includes an array of acoustic transducers comprising at least three monopole transducers that are arranged generally at different distances from the ear, and wherein a first monopole transducer is closest to an expected location of a first ear of the user, a second monopole transducer is proximate the first monopole transducer and is farther from the ear than the first monopole transducer, and a third monopole transducer is proximate the second monopole transducer and is farther from the ear than the second monopole transducer, and a controller that is adapted to provide array control signals that independently control the relative phases and amplitudes of each of the transducers, wherein the control signals cause the second monopole transducer to have an amplitude that is greater than that of the first and third monopole transducers, and wherein the control signals further cause the second monopole transducer to have a phase that is opposite that of the first and third monopole transducers.

DETAILED DESCRIPTION

Figure 1:
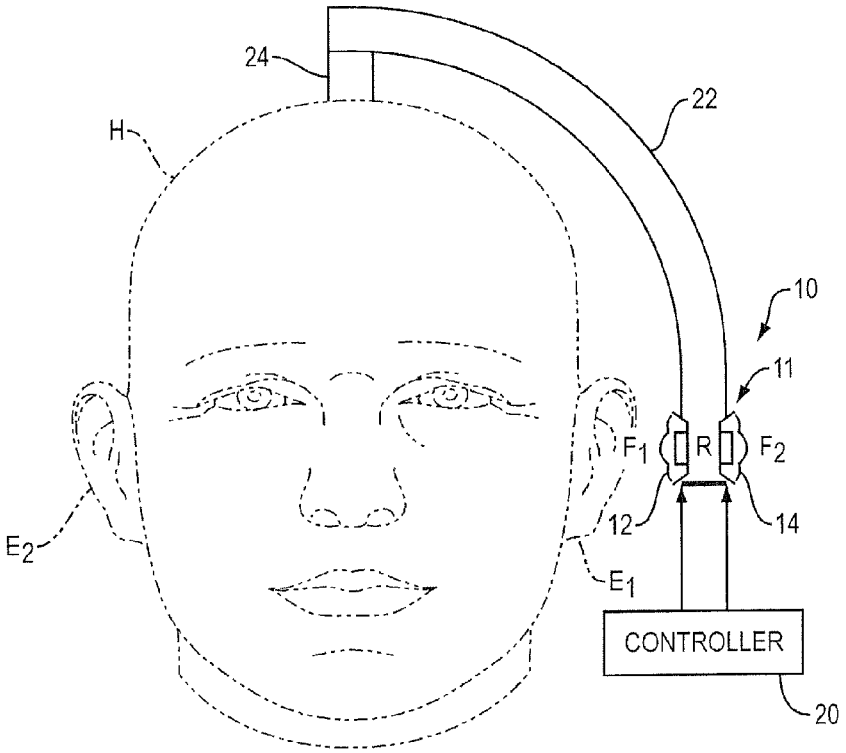
FIG. 1 is schematic diagram of an acoustic device.

This disclosure describes a body-worn acoustic device that comprises an array of acoustic transducers that together have at least three radiating surfaces. When used to provide sound to both ears, both sides of the device comprise such an array of acoustic transducers. The transducers are relatively close to but not touching the ears. In non-limiting examples the device can be worn on the head (e.g., with the transducers carried by a headband such as in an off-the-ear headphone), or can be worn on the body, particularly in the neck/shoulder area where transducers can be pointed up, generally toward the ear(s).

The acoustic device allows for independent control of the relative phases and amplitudes of each of the transducers. This arrangement is able to maximize the SPL delivered to the ears while minimizing the total radiated acoustic power to the far-field normalized to the SPL at the ear, also referred to herein as "spillage."

By this arrangement, the acoustic device can be located off the ears and still provide quality audio to the ears while at the same time inhibiting far-field high-frequency sound that can be heard by others who may happen to be located close to the user of the acoustic device. The acoustic device thus can effectively operate as open headphones, even in quiet environments. An aim is to allow the user to have a "personal" audio experience, such as listening to music, while keeping the ears uncovered. A goal is to produce the desired acoustic signal at the ear (e.g., the music), while minimizing sound radiated to the environment. By reducing this "acoustic spillage," the acoustic device can be used in a greater range of environments, reducing disturbance of neighbors, and increasing user privacy.

There are many types and configurations of acoustic transducers that can be used in the present acoustic device, and this disclosure is not limited to any particular type or configuration of transducer(s). As two non-limiting examples of types of transducers, one type has a single radiating surface, which can be accomplished by covering the back side of an oscillatable structure (e.g., a "speaker cone") with a sealed volume. At lower frequencies, such a speaker radiates substantially as a monopole, which is to say that the sound radiates approximately equally in all directions. In some of the drawings herein, monopoles are schematically depicted as short, squat cylinders, with a top radiating surface. Since monopoles radiate in all directions, it generally does not matter which direction the radiating surface is facing; what matters is where the radiating surface is located in space. One potential issue with monopoles is that if the back volume is small, the system is stiff and inefficient in terms of using power.

Another type of transducer comprises an oscillatable structure with two radiating surfaces. Basically, the opposed front and back sides of the radiating structure (e.g., the cone) are both open to the atmosphere. These are sometimes schematically depicted in the drawings herein as wide, thin, cylinders. At lower frequencies, such a transducer radiates approximately as a dipole. Such transducers can be very useful for the applications described herein, because they have little back pressure and are already "low spillage" to first order.

In order to reduce spillage below what can be accomplished with a single dipole transducer, or two monopole transducers with two radiating surfaces that share a common back volume (thus operating effectively like a single dipole), the acoustic devices herein preferably include a quadrupole acoustic radiator. Such an array is, generally, located near but not on each ear, although a single-ear device can have a single array located near a single ear. Array control signals are used to independently control the relative phases and amplitudes of each of the transducers. The control signals are effective to produce a desired acoustic pressure signal at the ear, while decreasing (preferably, minimizing) sound radiated to the environment.

Acoustic device 10, FIG. 1, includes acoustic transducer array 11 comprising transducers 12 and 14. Transducer 12 has one radiating surface facing side F1 and a second, opposed radiating surface facing side R. Similarly, transducer 14 has one radiating surface facing side F2 and a second, opposed radiating surface facing side R. Transducers 12 and 14 each generally function as dipole transducers. Transducer array 11 is carried by headband 22, which is coupled to the user's head H by standoff 24. Headband 22 is constructed and arranged such that transducers 12 and 14 are close to, but not touching, ear E1. Note that in most headphones there would be a second transducer array 11 close to but not touching second ear E2. Controller 20 is adapted to provide transducer array control signals that independently control the relative phases and amplitudes of each of transducers 12 and 14.

Figure 2:
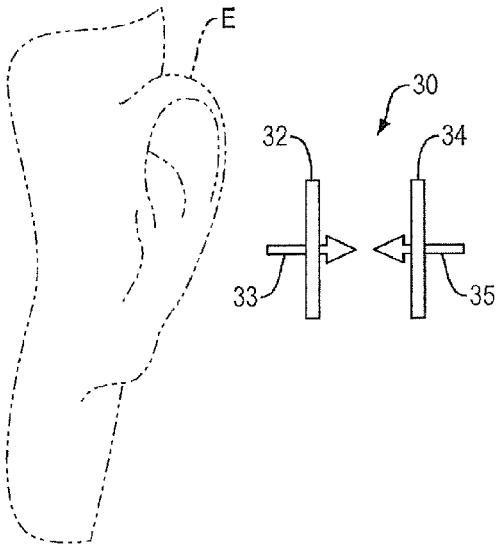
FIG. 2 illustrates an exemplary transducer array for an acoustic device.

It is possible to arrange two dipoles to approximately achieve a quadrupole acoustic radiator, for example by placing two identical dipole radiators next to each other, with faces of the same phase facing toward each other, and faces of the opposite phase facing away from each other. FIG. 2 illustrates a simplified example with dipole transducers 32 and 34 of transducer array 30 located close to ear E. Note that in this figure and in other figures that illustrate transducer arrays the relative phases of the transducers, at least in one non-limiting example, are indicated with arrows directed orthogonally to the transducer radiating surface. The direction in which the arrow is pointing may indicate one phase (e.g., +) while the opposite direction indicates an opposite phase (e.g., −). If this approximate quadrupole 30 is located in space, with no surfaces or objects nearby (e.g., an ear or head), it will radiate very little acoustic energy into the far field, much less than a dipole.

However, the presence of the head complicates the above free-space scenario, because sound reflects from it and diffracts around it. It has been determined that to obtain better spillage reduction, the amplitude of the outer dipole 34 (the dipole farther from the ear) needs to be modified as compared to the amplitude of the inner dipole 32 that is closer to the ear. In most cases, the outer dipole 34 needs to be reduced in amplitude. Also, as further described elsewhere herein, at higher frequencies spillage can be further reduced by changing the relative phases of the two dipoles. In order to accomplish amplitude and phase control of the two dipole transducers, a controller can accomplish a frequency-dependent function (i.e., a filter) that controls the magnitude and phase of the outer dipole relative to the inner dipole. Through experimentation or modeling, an appropriate filter can be applied to the outer dipole transducer, the inner dipole transducer or to both transducers. Generally, a goal of the filter is to minimize spillage at desired frequencies.

Figure 3A:
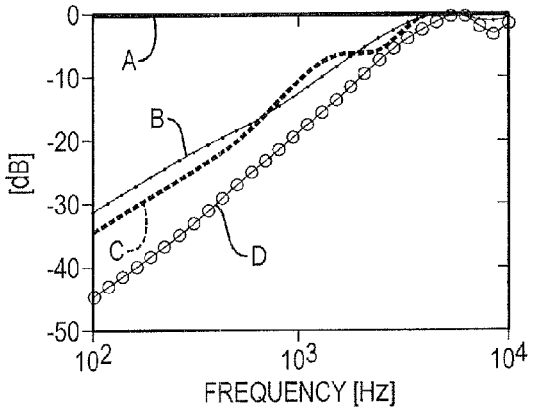
FIG. 3A is a plot of radiated power for several transducer arrays, relative to the power radiated by a simple monopole, for equal sound levels at the ear.
Figure 3B:
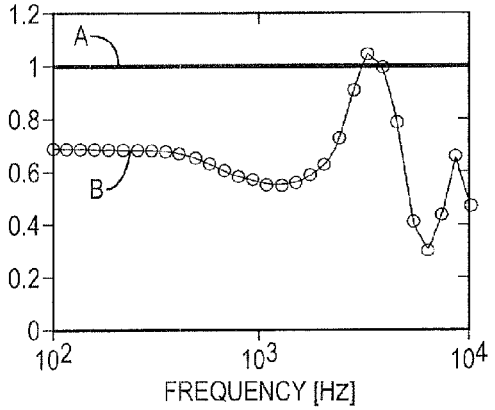
FIGS. 3B and 3C illustrate the relative magnitudes and phases of the transducers that are accomplished in a filter for one of the transducer arrays.
Figure 3C:
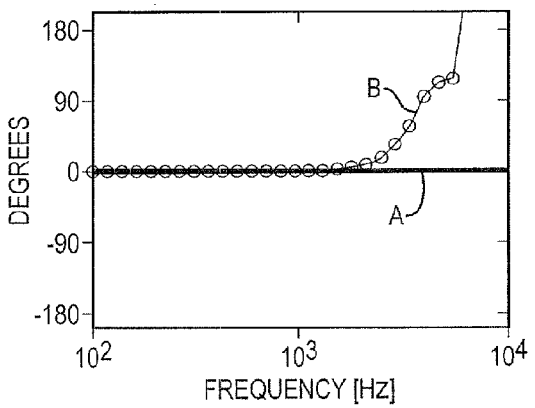

The plot of FIG. 3A illustrates the power radiated relative to a monopole transducer (curve A), for a single dipole transducer (curve B), a simple quadrupole array (i.e., two equal dipoles as shown in FIG. 2) (curve C), and a quadrupole array with an optimized filter (curve D), where in each case the array is equalized to produce equal sound at the ear The simple quadrupole (curve C) has similar performance to a single dipole (curve B). The quadrupole array with an optimized filter accomplishes less spillage (i.e., reduces radiated power) at most illustrated frequencies. For example, the quadrupole array with an optimized filter reduces spillage by about 10 dB at 100 Hz, by about 5 dB at 1 kHz, and by several dB at frequencies even above 1 kHz. FIGS. 3B and 3C illustrate the filter that gives the results of curve D, FIG. 3A. FIG. 3B describes the relative amplitudes of dipoles 32 and 34. It can be seen that at most frequencies, the outer transducer 34 (curve B) has its amplitude reduced to about 60% of that of the inner transducer 32 (curve A). FIG. 3C describes the relative phase of dipoles 32 and 34, where curve A is the phase of inner transducer 32 and curve B is the phase of outer transducer 34. The amplitude, phase, or both of the quadrupole-like array may be optimized to achieve a desired amount of spillage reduction based on the application. In addition, the size and space between the transducers, as well as the number of transducers can be modified to further reduce spillage. In general, spillage can be reduced by making the transducers smaller, reducing the space between the transducers and increasing the number of transducers. While curves B of FIGS. 3B and 3C reduced spillage optimally, and much simpler filter with constant phase and gain would accomplish the majority of the attainable spillage reduction, at reduced cost.

Figure 4A:
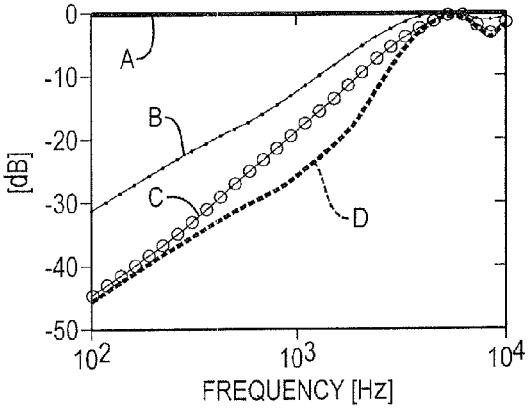
FIG. 4A is a plot of the relative radiated power for several transducer arrays, for equal sound levels at the ear.
Figure 4B:
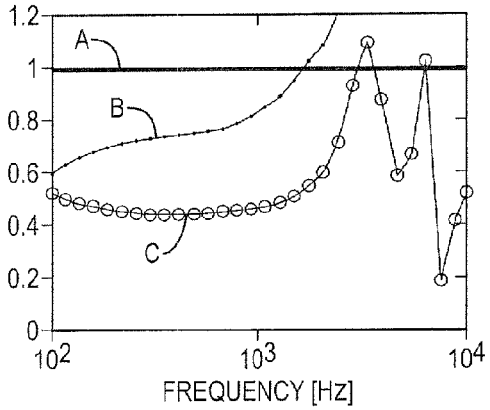
FIGS. 4B and 4C illustrate the relative magnitudes and phases of the transducers that are accomplished in a filter for one of the transducer arrays.
Figure 4C:
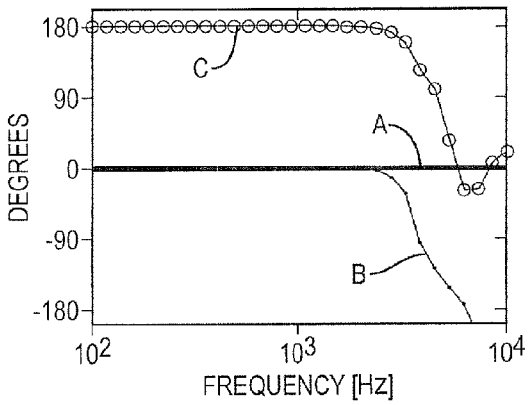

The transducer array can have more than two dipole transducers. For example, if a third dipole is added next to transducer 34 but farther away from ear E, the result using example filters are shown in FIGS. 4A-4C. FIG. 4A illustrates the power radiated relative to a monopole (curve A), for a single dipole (curve B), an optimized quadrupole-like array comprising two dipoles (as in FIG. 3A) (curve C), and an optimized three dipole array (curve D). Curve D illustrates a substantial improvement in a frequency band around 1-2 kHz. As further described below, a three dipole array can also be combined with tubes that are acoustically coupled to the transducers. For the filter illustrated in FIGS. 4B and 4C, FIG. 4B illustrates a relative magnitude of the transducers, with magnitudes relative to the middle transducer (curve A), for the inner transducer (i.e., the transducer closest to the ear) (curve B) and the outer transducer (i.e., the transducer farthest from the ear) (curve C), while FIG. 4C illustrates a relative phase of the transducers, with phase relative to the middle transducer (curve A), for the inner transducer (curve B) and the outer transducer (curve C).

The transducers in the arrays described herein need not be identical, and may be different sizes. For example, since one of the transducers in the array may need less amplitude than the other(s), it may be advantageous to make that transducer smaller, to allow the centers of the transducers to be closer together. For example, in array 30, FIG. 2, outer transducer 34 can have an amplitude that is about 60% of that of inner transducer 32. Transducer 34 can thus be made smaller than transducer 32. Also, when different types of transducers are used in an array, they may be of different sizes. These aspects are further described below.

Figure 5:
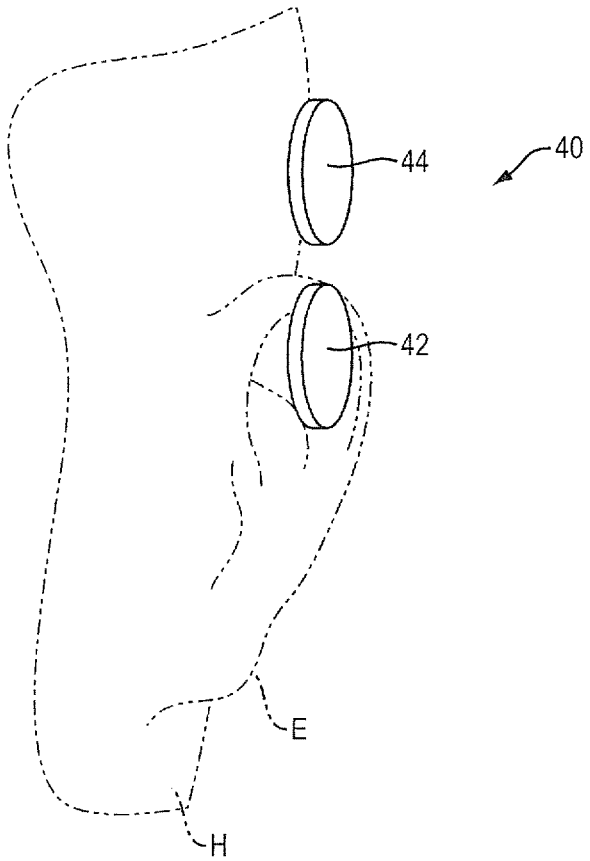
FIG. 5 illustrates an exemplary transducer array for an acoustic device.
Figure 6A:
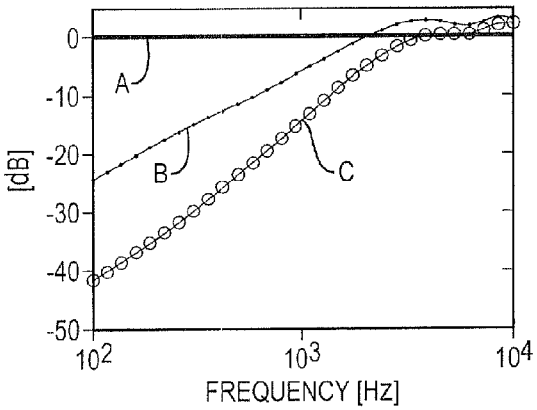
FIG. 6A is a plot of relative radiated power for several transducer arrays, for equal sound levels at the ear.
Figure 6B:
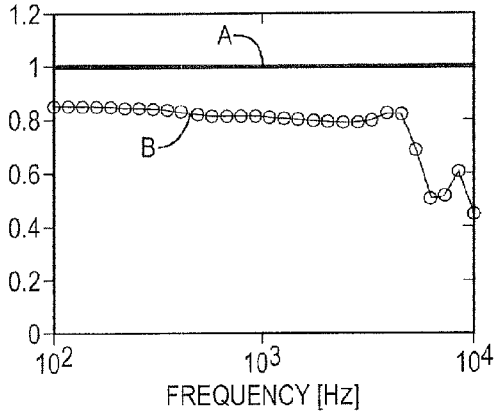
FIGS. 6B and 6C illustrate the relative magnitudes and phases of the transducers that are accomplished in a filter for one of the transducer arrays.
Figure 6C:
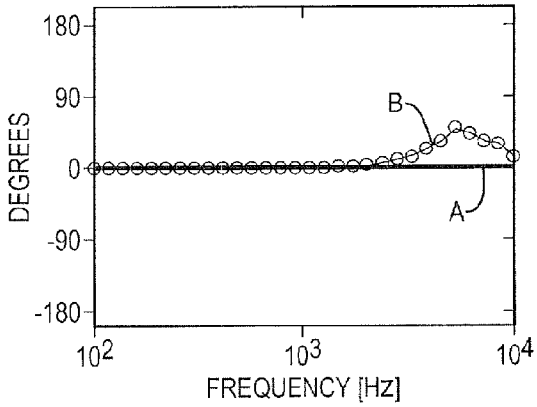

Also, the multiple transducers of the transducer array do not have to be lined up directly with the ear canal, or on a line going directly out from the head. In particular, the transducers could be located above or otherwise around the ear, as shown for example in FIG. 5. Also, the transducers do not need to share symmetry axes—one might be above the other, even though their axes both point horizontally, also as shown in FIG. 5, where dipole transducer 42 of transducer array 40 is located close to ear E and pointed generally toward head H, while dipole transducer 44 of array 40 is located higher up on the head and pointed along an axis that is generally parallel to that of transducer 44. Results and an example filter for the configuration of FIG. 5 are shown in FIGS. 6A-6C, where relative radiated power (FIG. 6A) is illustrated for a monopole (curve A), for a single dipole 42 (curve B) and for two dipoles 42 and 44 with an optimized filter (curve C). For the filter of FIGS. 6B and 6C, the magnitude plot (FIG. 6B) has transducer 42 magnitude plotted as curve A and that of transducer 44 plotted as curve B. Likewise, the phase plot (FIG. 6C) has transducer 42 phase plotted as curve A and that of transducer 44 plotted as curve B. At frequencies up to about 2 kHz, operating transducer 44 at about 80% of the amplitude of transducer 42 results in substantial spillage reduction in the range of about 5 dB to about 15 dB.

In the performance plots of FIGS. 6A-6C for the transducer arrangement of FIG. 5, the single dipole radiated power (curve B of FIG. 6A) goes above the monopole result (curve A) because, in this example, the monopole location (not shown) is just in front of the ear canal. An array comprising dipoles 42 and 44 is plotted in curve C.

Figure 7:
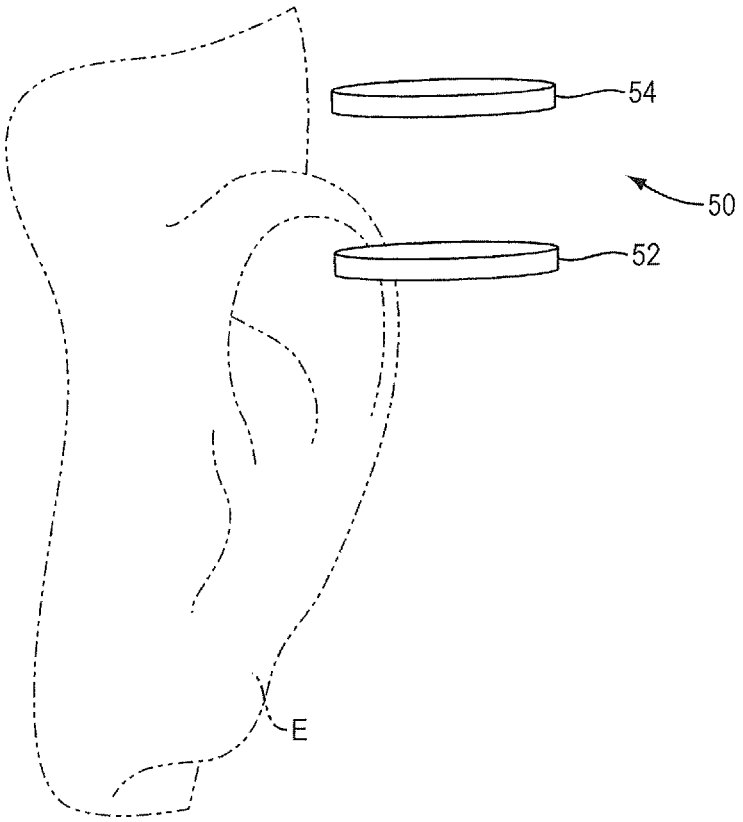
FIG. 7 illustrates an exemplary transducer array for an acoustic device.
Figure 8A:
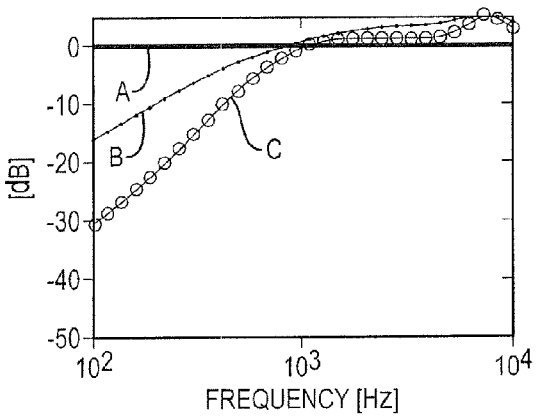
FIG. 8A is a plot of relative radiated power for several transducer arrays, for equal sound levels at the ear.
Figure 8B:
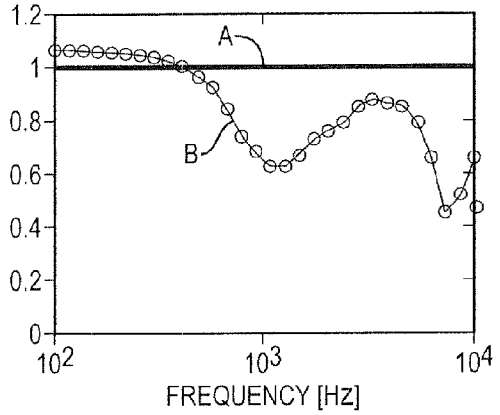
FIGS. 8B and 8C illustrate the relative magnitudes and phases of the transducers that are accomplished in a filter for one of the transducer arrays.
Figure 8C:
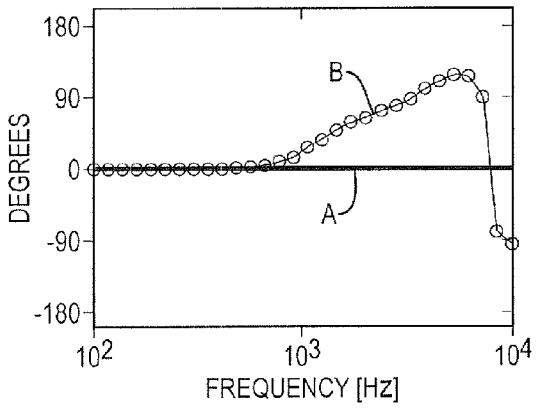

As another alternative transducer array arrangement, the axes of the transducers could be pointed vertically, in various locations above or around an ear. For example, FIG. 7 illustrates transducer array 50 with dipole transducers 52 and 54 pointed vertically, and located one above the other, above the ear canal of ear E. FIGS. 8A-8C illustrate relative radiated power and an example filter for array 50. Curve A, FIG. 8A, is of the monopole that is also plotted in FIG. 6A, curve B is for a single dipole 52, and curve C is for array 50. Curves A of FIGS. 8B (illustrating the relative amplitude of transducers 52 and 54) and 8C (illustrating the relative phase of transducers 52 and 54) are for transducer 52 and curves B are for transducer 54. This illustrates that vertical dipoles with the illustrated filter accomplish reduced spillage up to about 1 kHz.

The above illustrates that the transducers of the transducer array for the subject acoustic device can be located anywhere relatively close to the ear, with their sound axes pointed in any direction. Additional configurations are possible beyond the non-limiting examples shown and described above. For example, it is possible to have two transducers on opposite sides of the ear (e.g., one above and one below the ear canal), or side-by-side above the ear, below the ear, next to the ear, behind the ear, or in front of the ear.

Dipole transducers are not the most general case of transducers that can be used in the acoustic array of the subject acoustic device. Acoustically, each two-sided source is approximated by two single-sided sources, where such two sources are of opposite phase, and separated by a distance equal to the diameter of the dipole disk. Thus, as an alternative to the dipole transducers described thus far, the acoustic array of the subject acoustic device can have one or more monopole acoustic transducers.

Figure 9:
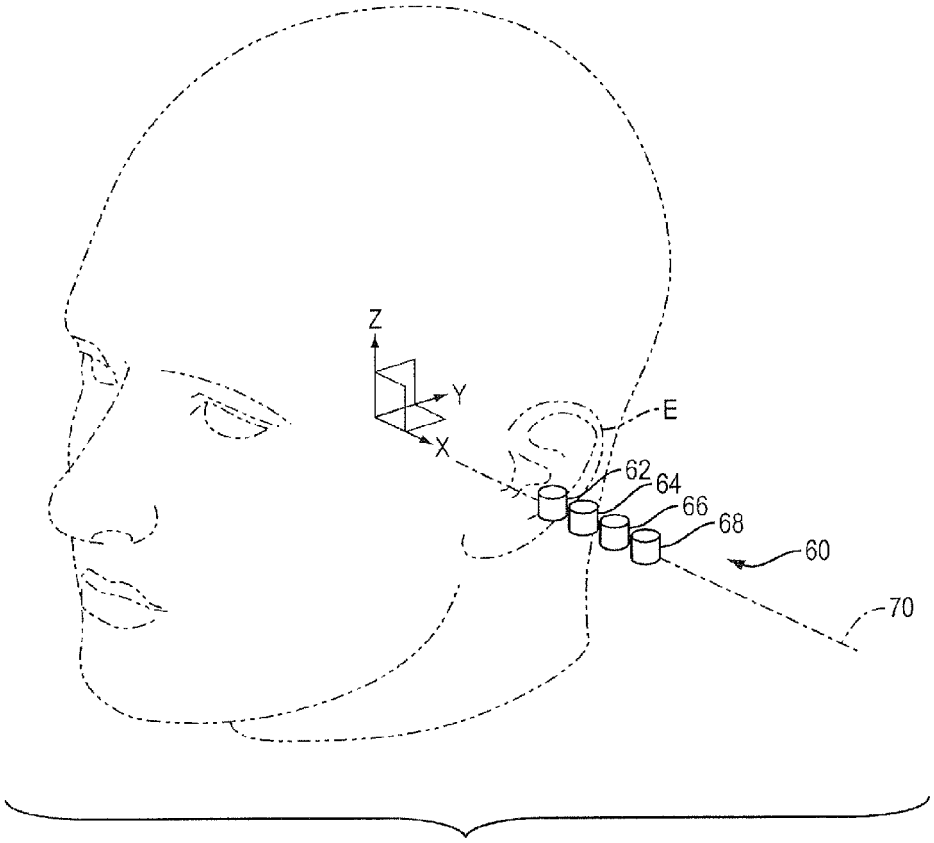
FIG. 9 illustrates an exemplary transducer array for an acoustic device.

For example, the two-dipole arrangement shown in FIG. 2 is acoustically equivalent to the four-monopole transducer array 60, FIG. 9, with four monopole transducers 62, 64, 66 and 68 all located proximate to ear E and lying generally along axis 70 that in this non-limiting example is generally orthogonal to the side of the head. As with the dipole transducers, the monopole transducers could be positioned in various configurations and orientations about the ear, including but not limited to on opposite sides of the ear (e.g., two above and two below the ear canal), or side-by-side above the ear, below the ear, next to the ear, behind the ear, or in front of the ear. Having multiple monopole transducers provides additional configurability compared to the dipole transducers because the magnitude and phase of each transducer can be controlled individually to achieve more tailored SPL at the ear and spillage reduction results.

Filters for an array of monopole transducers can be different than those for dipoles. At higher frequencies of around 3 kHz and above, a single dipole performs similarly to a single monopole, but an array of two monopoles (e.g., monopoles 62 and 64), with an appropriate filter, can reduce spillage over that of a dipole. Thus, two monopoles and a filter can improve spillage compared to a single dipole. As with the filters described herein for dipole transducers, the filter applied to the monopole array contemplates giving the outer monopole 64 a different relative amplitude and/or phase than inner monopole 62.

Figure 10A:
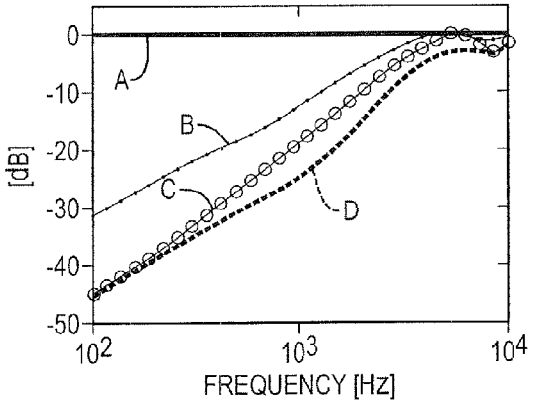
FIG. 10A is a plot of relative radiated power for several transducer arrays, for equal sound levels at the ear.
Figure 10B:
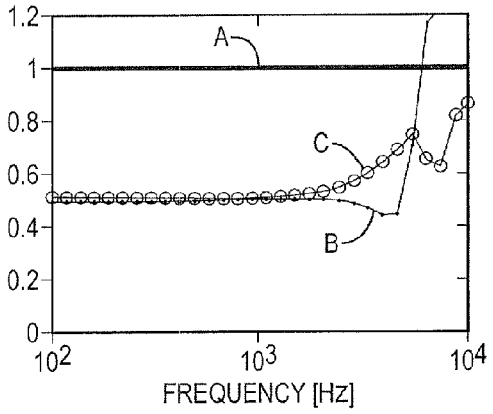
FIGS. 10B and 10C illustrate the relative magnitudes and phases of the transducers that are accomplished in a filter for one of the transducer arrays.
Figure 10C:
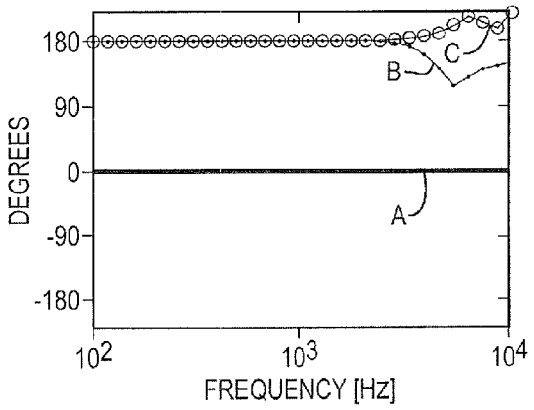

With three or more monopole transducers the radiated power can be further reduced for fixed pressure at the ear. For example, radiated power and a filter (magnitude and relative phase) for an array with three monopoles (e.g., monopoles 62, 64 and 66) are shown in FIGS. 10A-10C, respectively. FIG. 10A includes a single dipole (e.g., dipole 32, FIG. 2) (curve B), two dipoles (e.g., dipoles 32 and 34, FIG. 2) (curve C) and the three monopoles (curve D), compared to a single monopole (curve A). At lower frequencies, the three monopoles add to roughly zero volume displacement, so the back volumes of all three could be connected in order to minimize back pressure.

Because with multiple monopole transducers there is more control over the array, radiated power can generally be better controlled as compared to an array with multiple dipoles. Note that, in the example of three monopole transducers, the middle of the three transducers (transducer 64, plotted in curves A, FIGS. 10B and 10C) has the largest amplitude, and the other two transducers (inner transducer 62, curve B, and outer transducer 66, curve C) have lower amplitude. Relative phase is shown in FIG. 10C.

Figure 11A:
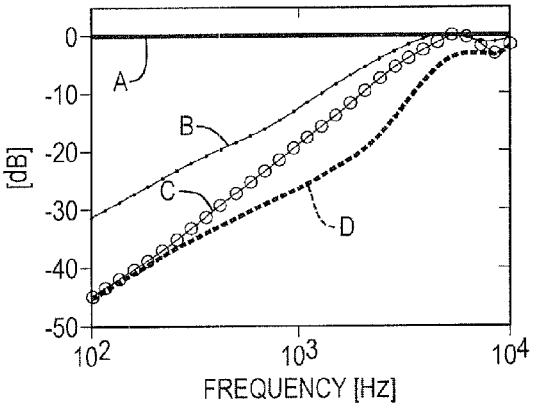
FIG. 11A is a plot of relative radiated power for several transducer arrays, for equal sound levels at the ear.
Figure 11B:
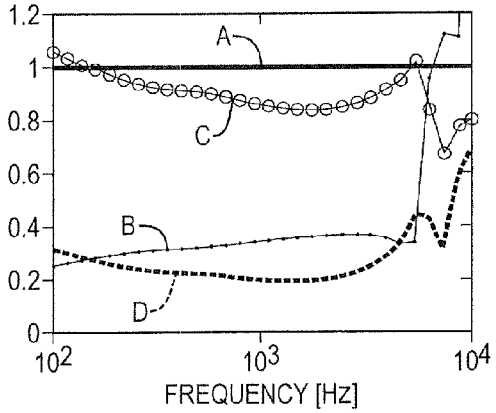
FIGS. 11B and 11C illustrate the relative magnitudes and phases of the transducers that are accomplished in a filter for one of the transducer arrays.
Figure 11C:
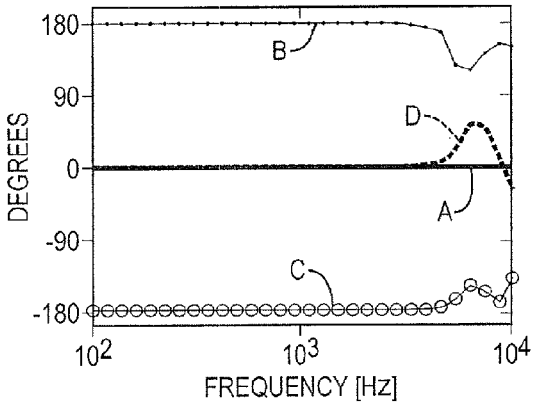

Similar results for array 60, FIG. 9, with four monopoles, are shown in FIGS. 11A-11C, where curves A, B and C are the same as curves A, B and C in FIG. 10, and curve D FIG. 11A is for the four monopoles, while curves D of FIGS. 11B and 11C are for outer transducer 68. FIG. 11B establishes that, in this configuration, the two outer sources (curves B and D) have lower amplitudes than the two inner sources (curves A and C), and the transducer phases differ from that of a quadrupole; in this case, the phases at low frequencies alternate, (e.g., −+−+).

Arrays with four or more monopoles can be arranged along rectilinear or curved axes vertically, horizontally, or in other directions, with an inner transducer closest to the ear, an outer transducer farthest from the ear, and center transducers between the inner and outer transducers. In such arrays, this same pattern occurs: alternating phase, with the center transducers having the highest amplitudes, with amplitudes that taper off toward the inner and outer transducers.

As is apparent from the data presented herein, in the subject acoustic device one or more transducers are being used in part to cancel the SPL produced by other transducers. There is a net gain in spillage reduction because the cancellation is greater in the far field than it is at the ear, because the ear is most strongly influenced by the transducers that are closer to it. But there is also less sound at the ear than if only one transducer were used or if all of the transducers were operated in phase with one other. The net result is that to make the desired level of sound at the ear requires more volume displacement from the transducers. As always, for a given SPL, more transducer displacement is required at lower frequencies. When these factors are combined with real-life transducer limits, it becomes difficult to make enough sound at the ear below some frequency with the four monopole array using the filter that minimizes spillage at every frequency.

However, the above plots of radiated power also establish that with any of the arrays described herein, there is less and less spillage as the frequency decreases. At relatively low frequencies there may be more spillage reduction than is needed in certain use cases that are contemplated for the acoustic device. Accordingly, it may be unnecessary in some cases to use the most-effective filter for spillage reduction. Instead, a different arrangement of phases and amplitudes that is not as effective at reducing spillage but that improves SPL at the ear can be used.

In some examples, it may be beneficial to vary the relative phase of the transducers over distinct frequency ranges. In one example using the four monopole transducer array 60, FIG. 9, (results summarized in Table 1 below), it was found that switching the relative phases in different frequency ranges would allow a trade-off between sound power delivered to the ear and power radiated to the environment so that better use can be made of a transducer's available volume displacement relative to the spillage reduction required at different frequencies.

TABLE 1

| Frequency | Phase of transducer 62 | Phase of transducer 64 | Phase of transducer 66 | Phase of transducer 68 |
|---|---|---|---|---|
| 1 kHz | + | − | + | − |
| 300 Hz | + | − | − | + |
| 120 Hz | + | + | − | − |
| 50 Hz | + | + | + | − |

In some examples, it may also be beneficial to focus spillage reduction on certain frequency bands, but not others. For example, spilled sound may be more irritating to persons in the vicinity of the acoustic device if low frequency spilled sound is completely absent while high frequency sound is unattenuated—the spectrally imbalanced sound may be more irritating than a spectrally balanced sound at higher overall levels. Accordingly, the filters for the transducer array can be designed such that spillage reduction is consistent across all frequencies—in other words, it may be beneficial to give up some of the spillage reduction available at the lowest frequencies in order to make better use of the transducers' available volume displacement or reduce the irritation caused by the spilled sound.

Figure 12:
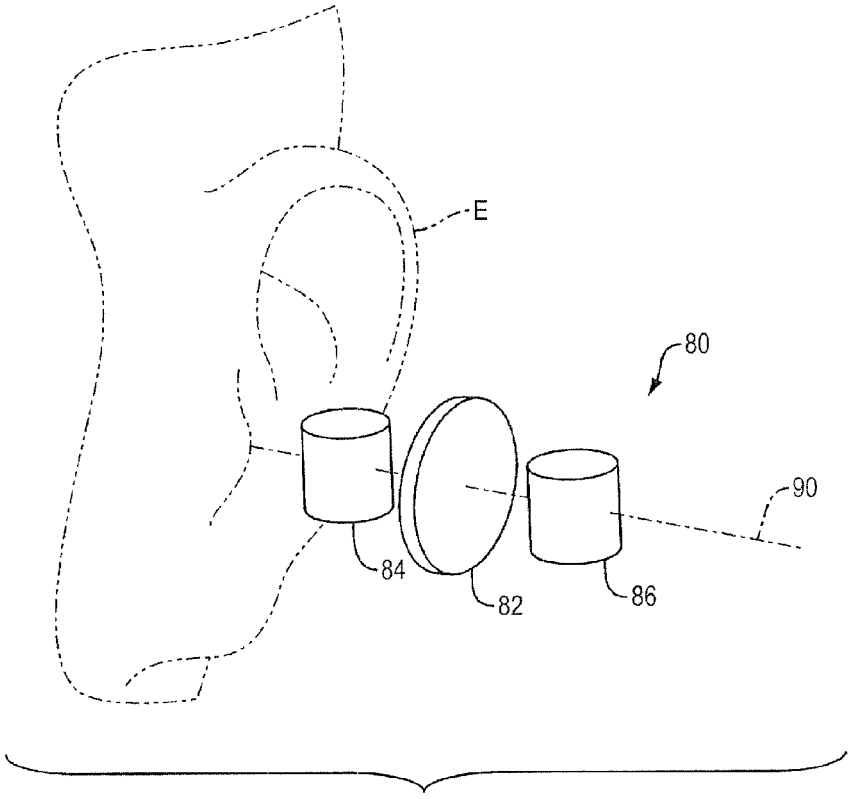
FIG. 12 illustrates an exemplary transducer array for an acoustic device.
Figure 13A:
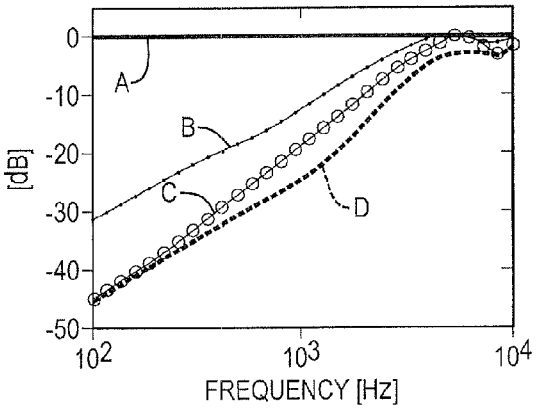
FIG. 13A is a plot of relative radiated power for several transducer arrays, for equal sound levels at the ear.
Figure 13B:
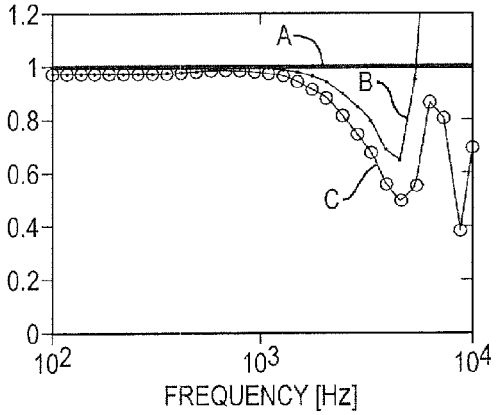
FIGS. 13B and 13C illustrate the relative magnitudes and phases of the transducers that are accomplished in a filter for one of the transducer arrays.
Figure 13C:
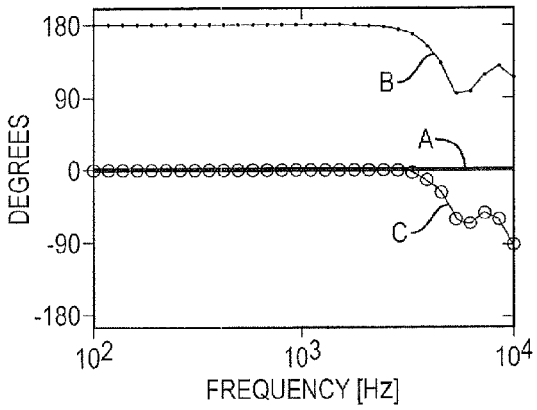

The acoustic arrays for the subject acoustic device can use any combination of two-sided transducers and one-sided transducers, such that the total number of radiating surfaces is at least three, and the total number of transducer control signals is at least two. For example, transducer array 80, FIG. 12, comprises dipole transducer 82 with monopole 84 that is closer to ear E and monopole 86 that is farther from ear E. The three transducers are generally located along axis 90, although as set forth above this is not necessary. Spillage performance and an example relative amplitude and phase filter are shown in FIGS. 13A-13C, respectively. In FIG. 13A, curve A is the radiated power of a single monopole 84, curve B is that of a single dipole 82, curve C is that of two dipoles (such as depicted in FIG. 2), optimized (i.e., with an optimum filter), and curve D is that of array 80, FIG. 12, with the filter shown in FIGS. 13B and 13C. In FIGS. 13B and 13C, curve A is for monopole 84, curve B is for dipole 82, and curve C is for monopole 86. A mixed array such as array 80 retains some of the simplicity and efficiency of the dipole, while adding some of the flexibility of the monopole array.

Figure 14:
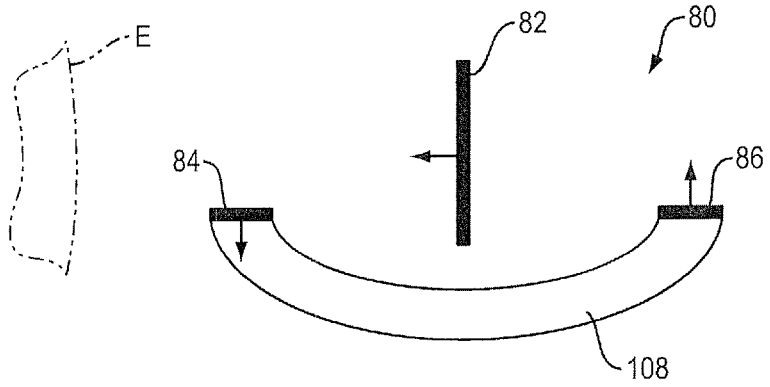
FIG. 14 illustrates an exemplary transducer array for an acoustic device.

In transducer arrays with two or more monopoles it can be beneficial for the monopoles to share a back volume so that when the transducers are out of phase the pressure in the back volume is reduced, which decreases the amount of power needed to create a desired SPL. The shared back volume can take a desired physical form, for example a tube or a cavity. FIG. 14 illustrates a tube 108 connecting the backs of monopole sources 84 and 86 from FIG. 12. Exemplary relative phases of the three transducers are indicated with the arrows.

An acoustic array for the subject acoustic device is able to achieve spillage reduction at higher frequencies if the radiating surfaces are located closer together. In order to accomplish this with the transducers themselves, the transducers can be made physically smaller so that they can fit closer together. However, smaller transducers actually require greater displacement in order to achieve the desired loudness at the ear because their area is smaller, so greater motion is required to move the same amount of air. This constraint is one reason that transducer size reduction alone is a limited solution to achieving spillage reduction at higher frequencies.

Figure 15:
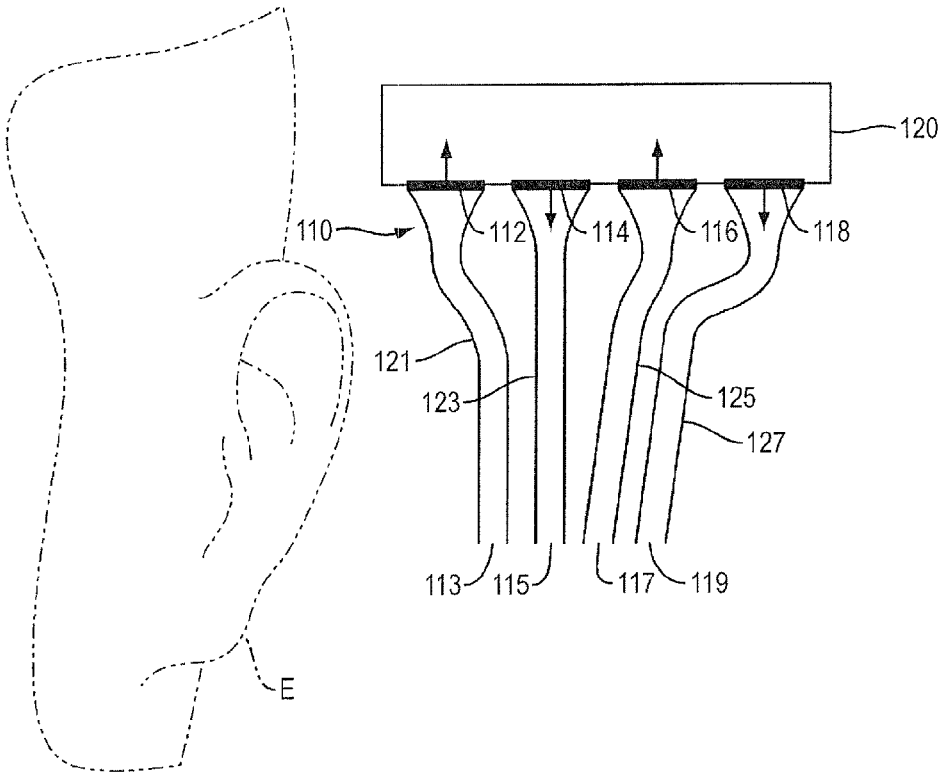
FIG. 15 illustrates an exemplary transducer array for an acoustic device.

Another means of achieving sound sources located relatively closer together that does not involve reducing the size of the transducers is to use larger transducers, which are necessarily located farther from the ear, and conduct the sound closer to the ear through tubes or waveguides that carry the sound from the radiating surface closer to the ear. FIG. 15 illustrates this concept, wherein transducer array 110 includes monopole transducers 112, 114, 116 and 118, which are each located at a distance from ear E. Tubes 121, 123, 125 and 127, respectively, carry sound from the transducers to tube outlets 113, 115, 117 and 119, respectively, where the tube outlets act as monopole sources. The physical arrangement of the transducers located side by side, or in other arrangements and relatively close together, also allows a common back volume 120 to be used.

The transducers of the transducer arrays described herein may be different sizes from one another. For best high frequency spillage reduction, the transducers should be small and close together. For increased acoustic amplitude at the ear, however, the transducers need to be larger, which requires them to be farther apart. The filters that minimize acoustic spillage generally require different maximum volume displacement from different transducers, so it can be advantageous to reduce the size of the transducers from which less output is required, so as to allow the centers of the transducers to be as close together as possible.

The transducer array filters can be optimized based on considerations of both spillage reduction and SPL at the ear, taking into account the constrained output available from any particular transducer of the array. The filters accordingly may not always achieve the absolute minimum spillage. The optimized filters may vary with frequency. For example, at a first frequency range the control signals may cause the array of acoustic transducers to act approximately like a monopole, at a second frequency range (higher than the first frequency range), the control signals may cause the array of acoustic transducers to act approximately like a dipole, and at a third frequency range (higher than the first and second frequency ranges), the control signals may cause the array of acoustic transducers to act approximately like a quadrupole. Further, at a fourth frequency range (higher than the first, second and third frequency ranges), the control signals may cause the array of acoustic transducers to act approximately like a multipole of a higher order than a quadrupole.

One purpose of spillage reduction is to avoid bothering others who are close by to the user of the acoustic device. The amount of spilled sound that is bothersome will itself depend on the amount of noise in the environment—in a very quiet place, even a small amount of spillage may be too much. And, the amount spilled depends in part on the overall sound level requested by the user. The acoustic device could thus use a microphone that detects the level of ambient sound, and the transducer control signals could be adjusted accordingly. For example, the control signals could automatically adjust the volume up and down in response to increases and decreases in ambient noise level. Also, the acoustic device could be enabled to produce a warning (e.g., an audible warning) if the user turns the volume up to a point that will likely result in "too much" spillage. The sound level that results in such a warning could be pre-set, or it could potentially be set by the user, depending on the sensitivity and tolerance of user's typical "neighbors." Alternatively, the sound level could be automatically established based on the amount of noise detected in the ambient environment.

Figure 16:
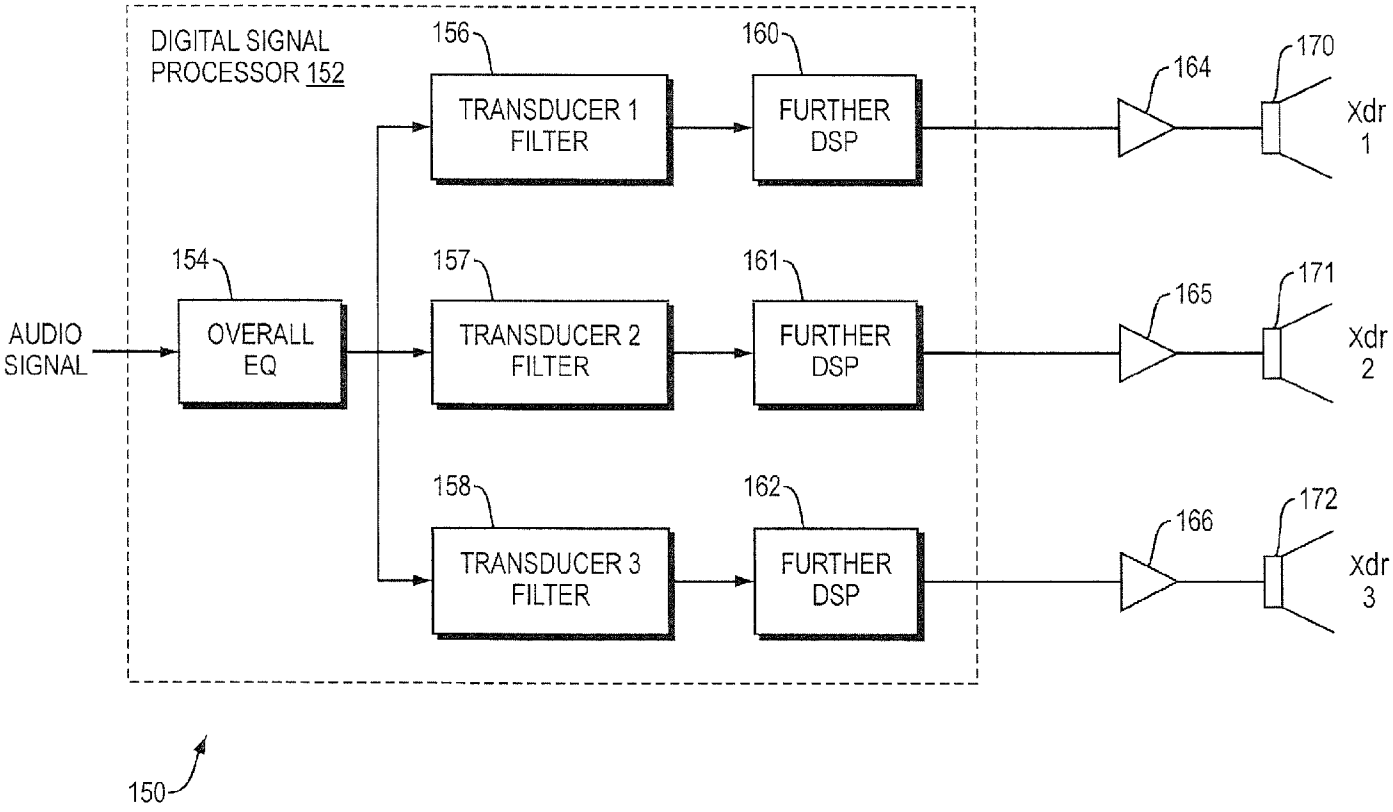
FIG. 16 is a schematic block diagram of an acoustic device.

A simplified block diagram of single-ear acoustic device 150 is shown in FIG. 16. For a more typical acoustic device with transducer arrays for each ear, there would be an acoustic device 150 for each ear. An audio signal is input to digital signal processor (DSP) 152, which accomplishes overall signal equalization 154. The signals for channels 1-3 that are for transducers 170-172 are then provided to individual filters 156-158 (e.g., the filters described above), and then to any further needed processing 160-162 (e.g., processing of types known in the art, such as limiters, compressors, dynamic EQ, and the like). The signals are amplified 164-166 and then provided to transducers 170-172. While three transducers are shown in FIG. 16, additional or fewer transducers and corresponding signal paths could be used, depending on the number of transducers in the array.

Elements of FIG. 16 are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are not all depicted in the drawing.

An acoustic device of the present disclosure can be accomplished in many different form factors. Following are several non-limiting examples. The transducers could be in a housing on each side of the head and connected by a band such as those used with more conventional headphones, and the location of the band could vary (e.g., on top of the head, behind the head or elsewhere). The transducers could be in a neck-worn device that sits on the shoulders/upper torso, such as depicted in U.S. patent application Ser. No. 14/799,265, filed on Jul. 14, 2015, the disclosure of which is incorporated herein by reference. The transducers could be in a band that is flexible and wraps around the head. The transducers could be integral with or coupled to a hat, helmet or other head-worn device. This disclosure is not limited to any of these or any other form factor, and other form factors could be used. Without limiting the generality of the proximity of the transducers of the subject acoustic device to the head, in head-worn devices the transducers may be within approximately 100 mm of the ears, whereas in neck or other body-worn devices the transducers may be within approximately 200 mm of the ears. The exact distance varies based on the particular application.

A patent application entitled "Acoustic Device," inventors Nathan Jeffery and Roman Litovsky, Ser. No. 15/174,086, filed on the same date herewith (and incorporated fully herein by reference), discloses an acoustic device that is also constructed and arranged to reduce spillage. The acoustic device disclosed in the application incorporated by reference could be combined with the acoustic device disclosed herein in any logical or desired manner, so as to achieve additional and possibly broader band spillage reduction. Also, for the arrays of the present disclosure to achieve good spillage reduction at frequencies above about 1 kHz the transducers will likely be relatively small. Such transducers may not be capable of moving enough air to produce bass sounds below about 200 Hz at acceptable SPLs. The acoustic device disclosed in the application incorporated by reference may thus be used to provide the bass that may be difficult to achieve with the acoustic device of the present disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. An acoustic device that is adapted to be worn on the body of a user, comprising: a structure that is adapted to be worn on the body of a user;

an array of acoustic transducers comprising first and second dipole transducers, each such dipole transducer comprising an oscillatable structure with opposed front and back sides that are open to the atmosphere, wherein the front and back sides are constructed and arranged to radiate sound that is out of phase, where the dipole transducers are held by the structure such that the dipole transducers are adjacent a first ear of the user; and a controller that is adapted to provide array control signals that independently control the relative phases and amplitudes of each of the dipole transducers, to reduce the power of sound radiated by the array away from the first ear of the user.

2. The acoustic device of claim 1, wherein the first dipole transducer is closer to the first ear of the user than is the second dipole transducer.

3. The acoustic device of claim 2, wherein the control signals are frequency dependent.

4. The acoustic device of claim 2, wherein the control signals reduce the amplitude of the second dipole transducer relative to that of the first dipole transducer over at least a first frequency range of the acoustic device.

5. The acoustic device of claim 4, wherein the first and second dipole transducers are different in size.

6. The acoustic device of claim 1, wherein the control signals reduce the amplitude of a dipole transducer relative to that of another dipole transducer in a frequency range.

7. The acoustic device of claim 1, wherein the control signals vary the phases of the first and second dipole transducers relative to each other.

8. The acoustic device of claim 1, wherein the array of acoustic transducers further comprises a third dipole transducer that comprises an oscillatable structure with opposed front and back sides that are open to the atmosphere, wherein the front and back sides are constructed and arranged to radiate sound that is out of phase, where the third dipole transducer is held by the structure adjacent the first ear of the user.

9. The acoustic device of claim 8, further comprising a tube acoustically coupled to a radiating surface of at least one dipole transducer, to carry sound closer to the first ear of the user.

10. The acoustic device of claim 1, wherein the control signals control at least one of: the amplitudes and phases of the dipole transducers in response to ambient noise levels.

11. The acoustic device of claim 1, wherein the first and second dipole transducers are different in size.

12. The acoustic device of claim 11, wherein the first dipole transducer is larger in size than the second dipole transducer.

13. The acoustic device of claim 12, wherein the second dipole transducer is located farther from the first ear of the user than is the first dipole transducer.

14. The acoustic transducer of claim 1, further comprising a tube acoustically coupled to a radiating surface of a dipole transducer so as to carry sound radiated by the radiating surface, the tube having an opening located closer to the first ear of the user than is the first dipole transducer.

15. The acoustic transducer of claim 1, wherein the first and second dipole transducers are different in size, and wherein the control signals are adapted to control at least one of the amplitudes and phases of the dipole transducers in response to ambient noise levels.

16. The acoustic device of claim 1, wherein the first and second dipole transducers are held proximate one another, where the control signals control the first and second dipole transducers to be driven out of phase with each other, at least over a frequency range.

17. The acoustic device of claim 1, wherein each of the first and second dipole transducers radiates directly toward and directly away from the first ear of the user.

18. The acoustic device of claim 1, wherein each of the first and second dipole transducers radiates along an axis that extends outwardly from the first ear of the user.

19. The acoustic device of claim 1, wherein one of the first and second dipole transducers radiates directly toward and directly away from the first an ear of the user and the other of the first and second dipole transducers radiates directly toward and directly away from a different location of the head of the user.

20. The acoustic device of claim 1, wherein each of the first and second dipole transducers radiates along an axis that does not intersect the first ear of the user.

21. The acoustic device of claim 20, wherein the axis is vertical.

22. The acoustic device of claim 21, wherein the first and second dipole transducers are located one above the other along the vertical axis.

23. The acoustic device of claim 2, wherein the controller implements a filter that controls the amplitude of the second dipole transducer to be less than the amplitude of the first dipole transducer at frequencies up to over 1 KHz.

24. The acoustic device of claim 23, wherein the filter drives the first and second dipole transducers in-phase at frequencies up to over 1 KHz.

25. An acoustic device that is adapted to be worn on the body of a user, comprising: a structure that is adapted to be worn on the body of a user;

an array of acoustic transducers comprising first and second dipole transducers, each such dipole transducer comprising an oscillatable structure with opposed front and back sides that are open to the atmosphere, wherein the front and back sides are constructed and arranged to radiate sound that is out of phase, where the dipole transducers are held by the structure such that the dipole transducers are adjacent a first ear of the user;

a controller that is adapted to provide array control signals that independently control the relative phases and amplitudes of each of the dipole transducers, to reduce the power of sound radiated by the array away from the first ear of the user;

wherein each of the first and second dipole transducers radiates directly toward and directly away from the first ear of the user; and wherein the controller implements a filter that controls the amplitude of the second dipole transducer to be less than the amplitude of the first dipole transducer at frequencies up to over 1 KHz, wherein the filter drives the first and second dipole transducers in-phase at frequencies up to over 1 KHz.

* * * * *